US011753219B2

(12) United States Patent
Funahashi

(10) Patent No.: US 11,753,219 B2
(45) Date of Patent: Sep. 12, 2023

(54) CAP OF CONTAINER, CONTAINER AND CONTENT CONTAINING BODY, METHOD FOR PRODUCING CAP OF CONTAINER AND CONTAINER CAP PRODUCING APPARATUS, AND METHOD FOR PRODUCING CONTENT CONTAINING BODY AND CONTENT CONTAINING BODY PRODUCING APPARATUS

(71) Applicant: Kazuki Funahashi, Kanagawa (JP)

(72) Inventor: Kazuki Funahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/742,858

(22) Filed: May 12, 2022

(65) Prior Publication Data

US 2022/0388744 A1 Dec. 8, 2022

(30) Foreign Application Priority Data

Jun. 8, 2021 (JP) ..... 2021-095560

(51) Int. Cl.
*B65D 51/24* (2006.01)
*B65D 41/08* (2006.01)

(52) U.S. Cl.
CPC ..... *B65D 51/245* (2013.01); *B65D 41/08* (2013.01)

(58) Field of Classification Search
CPC ..... B65D 51/245; B65D 41/08
USPC ..... 215/228
See application file for complete search history.

(56) References Cited

U.S. PATENT DOCUMENTS 3,818,858 A * 6/1974 Kramer ..... A47J 47/02 D7/629
4,037,559 A * 7/1977 Hopkins ..... B65D 51/245 40/311
5,048,711 A * 9/1991 Weiss ..... B65D 55/06 215/230
10,399,753 B1 * 9/2019 Migas ..... B65D 41/0421
11,208,241 B1 * 12/2021 Gillman ..... B65D 51/2842
2006/0180566 A1 * 8/2006 Mataya ..... A61J 1/1425 215/230
2009/0134113 A1 * 5/2009 Yan ..... B65D 41/485 215/230
2017/0360226 A1 * 12/2017 Zeidan ..... B65D 51/245

(Continued)

FOREIGN PATENT DOCUMENTS

DE 102004052163 A1 * 4/2006 ..... B65D 41/34
DE 102010001120 A1 7/2011

(Continued)

OTHER PUBLICATIONS

Extended European Search Report dated Oct. 31, 2022 issued in corresponding European Appln. No. 22172794.4.

*Primary Examiner* — J. Gregory Pickett
*Assistant Examiner* — Niki M Eloshway
(74) *Attorney, Agent, or Firm* — Harness, Dickey & Pierce, P.L.C.

(57) ABSTRACT

Provided is a cap of a container. The cap has an image formed thereon and includes a first part and a second part. When the cap is opened, the first part is separated from a container body of the container, and the second part remains on the container body of the container. The image is formed on a region straddling both a side surface of the first part and a side surface of the second part.

11 Claims, 17 Drawing Sheets

(56) References Cited

U.S. PATENT DOCUMENTS

| | | | | |
|---|---|---|---|---|
| 2018/0170633 | A1* | 6/2018 | Abbascia, Jr. | B65D 23/12 |
| 2022/0097414 | A1 | 3/2022 | Hirayama et al. | |
| 2022/0118553 | A1 | 4/2022 | Miyanishi et al. | |

FOREIGN PATENT DOCUMENTS

| | | | | | |
|---|---|---|---|---|---|
| GB | 2347663 | A | * | 9/2000 | B65D 51/245 |
| JP | 2001-114312 | A | | 4/2001 | |
| JP | 2002-279268 | | | 9/2002 | |
| JP | 2003-011342 | | | 1/2003 | |
| JP | 3104716 | | | 7/2004 | |
| JP | 2006-107075 | | | 4/2006 | |
| JP | 4532259 | | | 6/2010 | |
| JP | 2011-011819 | | | 1/2011 | |
| JP | 4826108 | | | 9/2011 | |
| JP | 5218744 | | | 3/2013 | |
| JP | 5592736 | | | 8/2014 | |
| JP | 5603179 | | | 8/2014 | |
| JP | 5855714 | | | 12/2015 | |
| JP | 2016-041595 | A | | 3/2016 | |
| JP | 2021-176648 | | | 11/2021 | |
| JP | 2022-015739 | | | 1/2022 | |
| JP | 2022-056333 | | | 4/2022 | |
| JP | 2022-057612 | | | 4/2022 | |
| JP | 2022-058127 | | | 4/2022 | |
| WO | WO-2007045894 | A1 | * | 4/2007 | B65D 41/3409 |
| WO | WO-2011/089191 | A1 | | 7/2011 | |
| WO | WO-2011089191 | A1 | * | 7/2011 | B41J 3/4073 |

* cited by examiner

CAP OF CONTAINER, CONTAINER AND CONTENT CONTAINING BODY, METHOD FOR PRODUCING CAP OF CONTAINER AND CONTAINER CAP PRODUCING APPARATUS, AND METHOD FOR PRODUCING CONTENT CONTAINING BODY AND CONTENT CONTAINING BODY PRODUCING APPARATUS

CROSS-REFERENCE TO RELATED APPLICATIONS

The present application claims priority under 35 U.S.C. § 119 to Japanese Patent Application No. 2021-095560 filed Jun. 8, 2021. The contents of which are incorporated herein by reference in their entirety.

BACKGROUND OF THE INVENTION

Field of the Invention

The present disclosure relates to a cap of a container, a container and a content containing body, a method for producing a cap of a container and a container cap producing apparatus, and a method for producing a content containing body and a content containing body producing apparatus.

Description of the Related Art

In recent years, containers such as PET bottles need reduction in use of plastic and similar materials and an improved recyclability as the measures for environmental issues. For example, a proposed label-less technique forms an image representing information such as a name and ingredients directly on the surface of a container using a carbon dioxide laser, to provide a label-less container (for example, see Japanese Unexamined Patent Application Publication No. 2011-11819).

Because such label-less techniques form images that hitherto have been printed on labels directly on the container bodies of containers, a sufficient readability of the images may not be obtained depending on the kinds of the container bodies or of the images. Hence, techniques of forming a part of an image, particularly, an image representing, for example, a barcode that needs a high readability, not on container bodies but on container caps that are opaque and less likely to be affected by the content and the environment are being attempted, and a proposed technique forms an image on, for example, the top surface of a container cap by laser light or an ink (for example, see Japanese Patent No. 4532259).

SUMMARY OF THE INVENTION

According to an aspect of the present disclosure, a cap of a container has an image formed thereon. The cap includes a first part and a second part. When the cap is opened, the first part is separated from a container body of the container, and the second part remains on the container body of the container. The image is formed on a region straddling both a side surface of the first part and a side surface of the second part.

DESCRIPTION OF THE EMBODIMENTS

The mode for carrying out the present disclosure will be described below with reference to the drawings. The embodiments described below are intended to illustrate, for example, a cap of a container, a container, and a content containing body for embodying the technical idea of the present disclosure. The present disclosure should not be construed as being limited to the embodiments described below.

The present disclosure has an object to provide a cap of a container, the cap having a highly readable image on a side surface of the cap.

The present disclosure can provide a cap of a container, the cap having a highly readable image on a side surface of the cap.

First, a cap of a container, a container, and a content containing body, which are the objectives of the present disclosure, will be described, taking, a PET bottle drink, in which a drink is contained in a PET bottle, for example.

Figure 1:
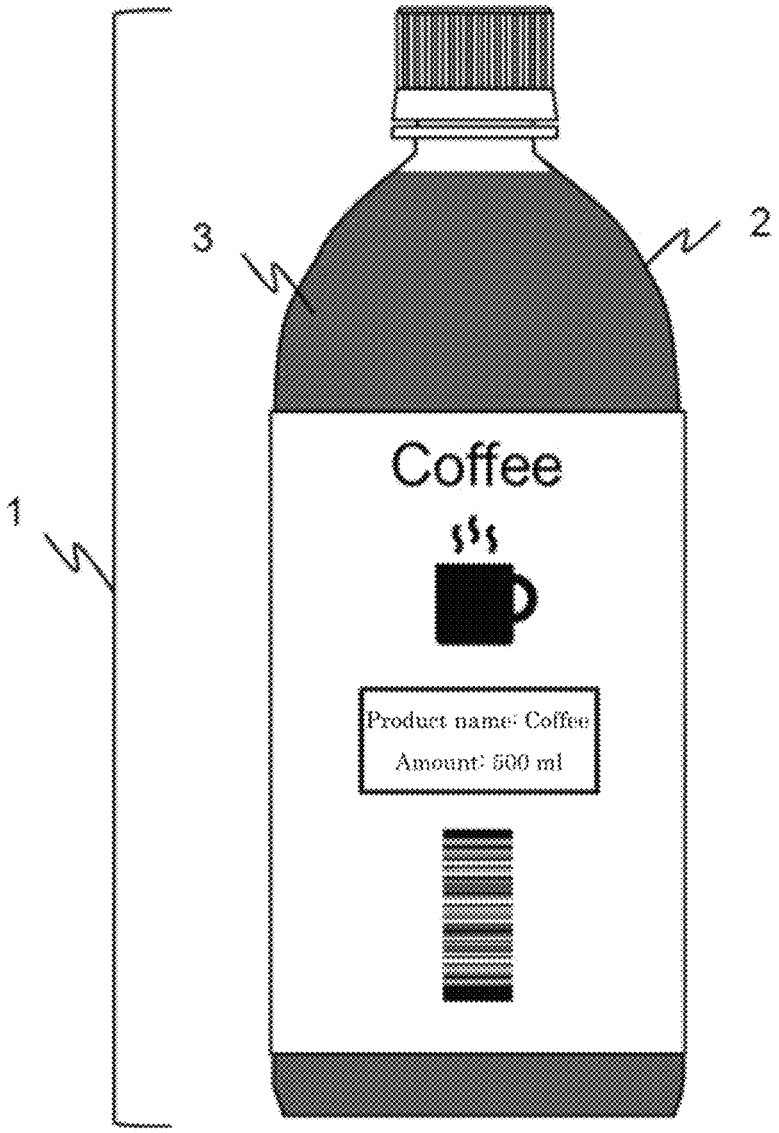
FIG. 1 is a schematic view illustrating an example of a PET bottle drink as a content containing body.

FIG. 1 is a schematic view illustrating an example of a PET bottle drink 1 as a content containing body. The PET bottle drink 1 is formed of a PET bottle 2 as a container, and a drink 3 as a content.

Figure 2:
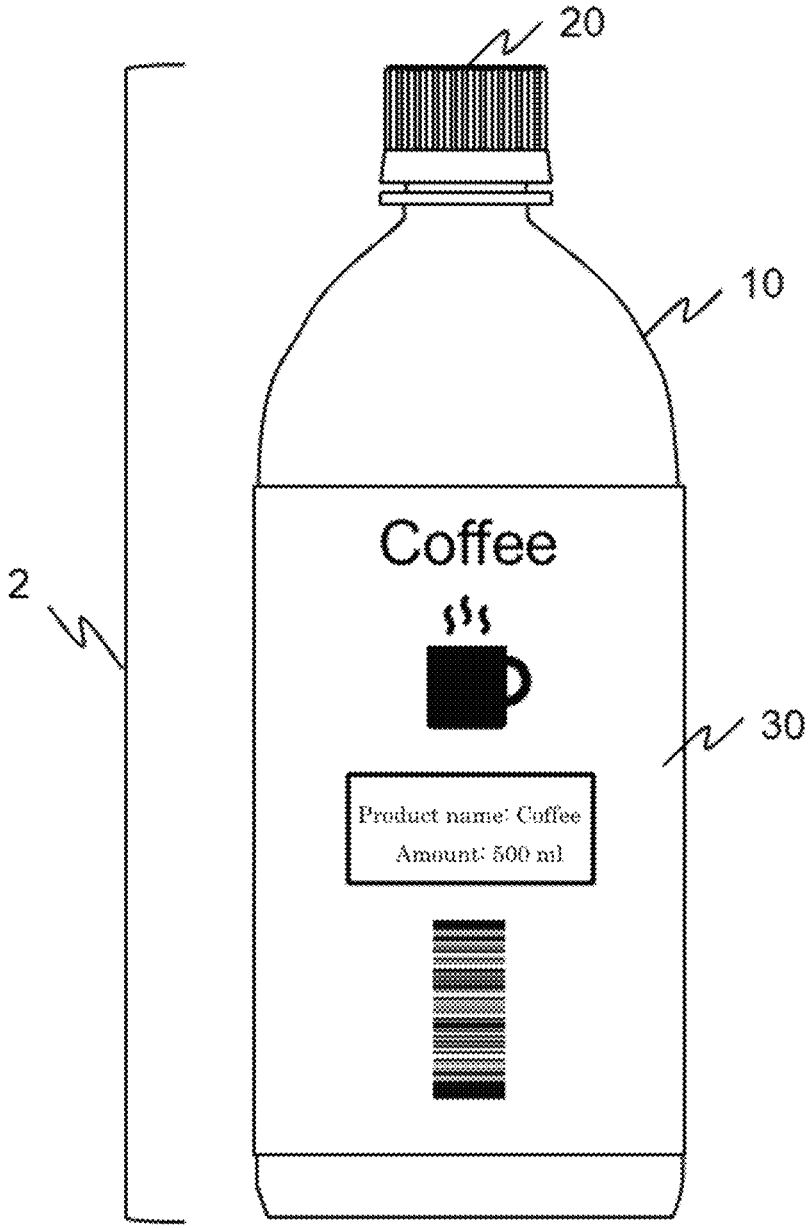
FIG. 2 is a schematic view illustrating an example of a PET bottle as a container.

FIG. 2 is a schematic view illustrating an example of a PET bottle 2 as a container. The PET bottle 2 is formed of a container body 10, a cap 20 of a container, and a label 30.

The container body 10 is a bottle obtained by molding a material, which is, for example, polyethylene terephthalate (PET), and is typically transparent. The cap 20 of a container is a lid obtained by molding a material, which is, for example, polyethylene (PE), and is typically opaque.

Figure 3A:
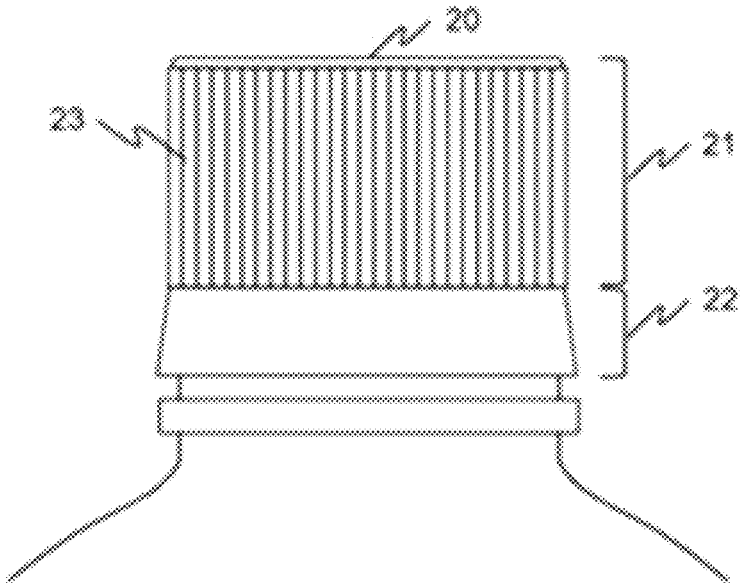
FIG. 3A is a view illustrating an example of a cap of a container, illustrating a state of the cap being attached on the container body.
Figure 3B:
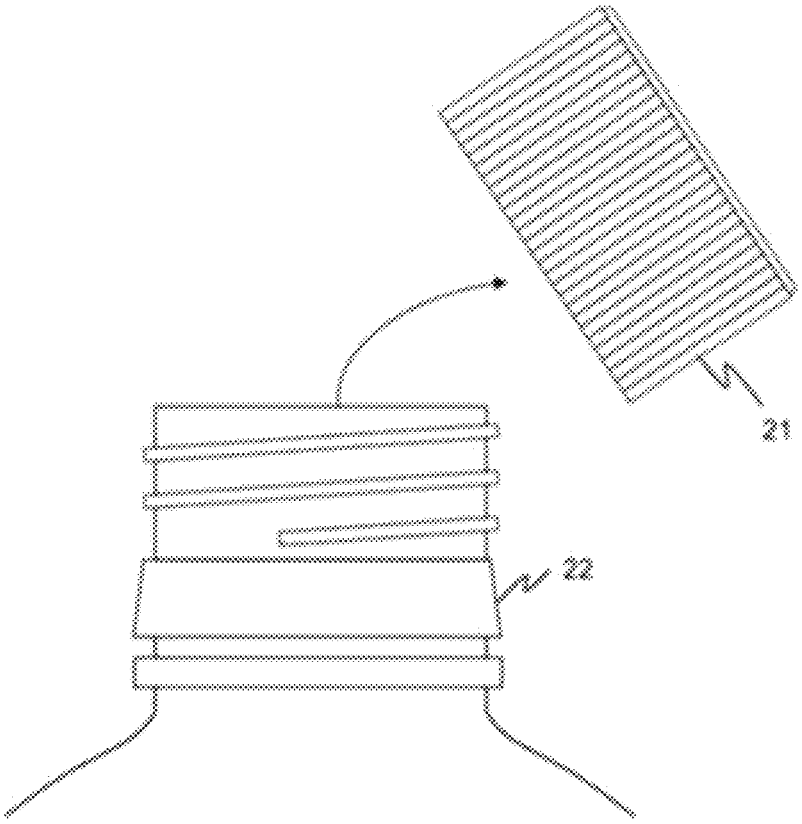
FIG. 3B is a view illustrating an example of a cap of a container, illustrating a state of the cap being opened.

The cap 20 of a container includes a first part 21 that is separated from the container body when the cap is opened, and a second part 22 that remains on the container body when the cap is opened, as illustrated in FIG. 3A and FIG. 3B. In general, the first part 21 has a boss and recess profile 23 on the surface of the side surface thereof in order to prevent a hand from slipping when opening the cap. In general, the second part 22 has no boss and recess profile 23 but a smooth surface on the side surface thereof.

As illustrated in FIG. 1 and FIG. 2, product information of the PET bottle drink 1 such as a product name, a product logo, and ingredients and an amount, or an identification code of the PET bottle drink 1 such as a barcode is printed on the label 30.

Figure 4:
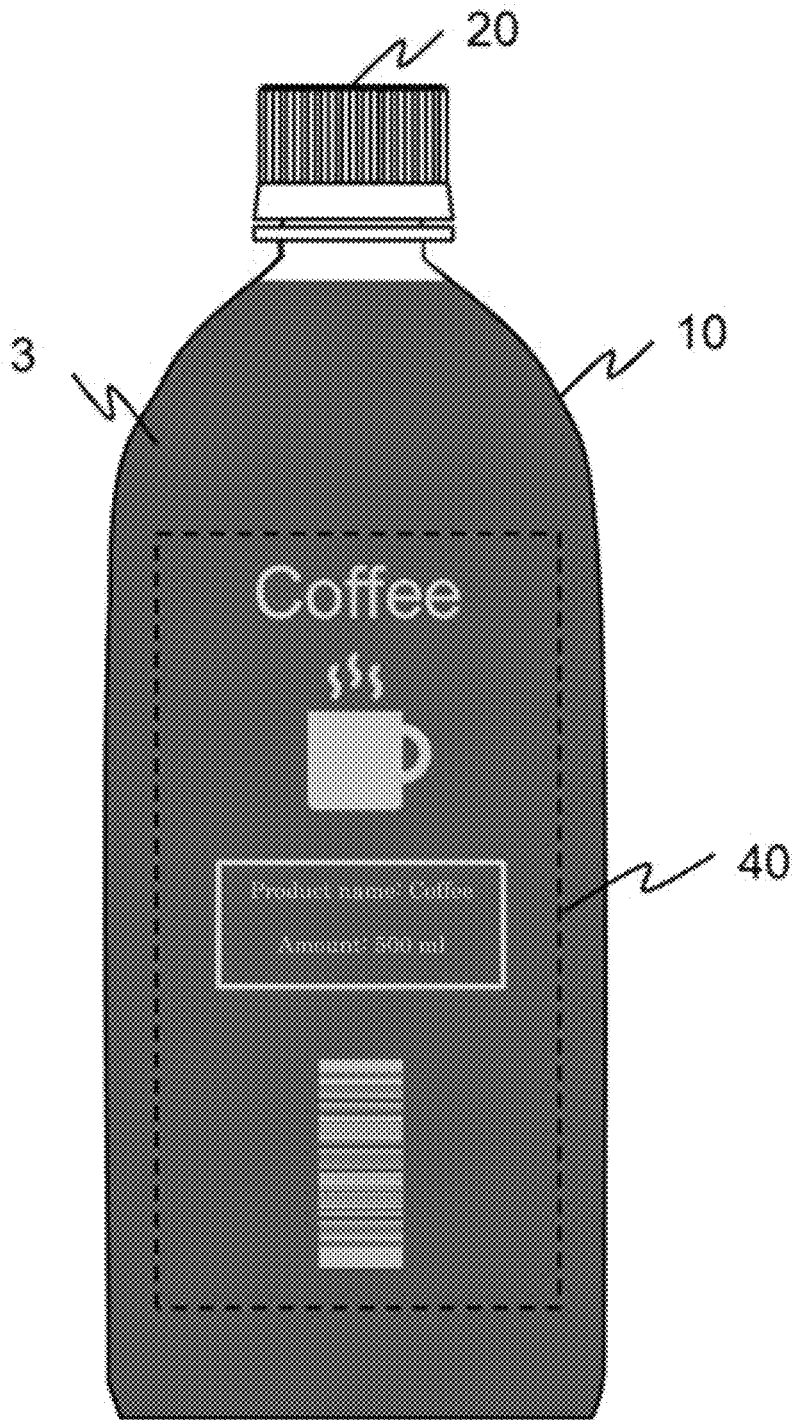
FIG. 4 is a schematic view illustrating an example of a PET bottle drink that is made label-less by a laser marking technique.

Containers such as PET bottles need reduction in use of plastic and similar materials and an improved recyclability as the measures for environmental issues. Label-less for doing without the label 30 is expected as one measure. A known label-less technique forms an image including, for example, letters and graphics on the container body 10 by embossing during bottle molding, and label-less products have already been realized in specific sales channels such as EC pack sales. Moreover, a laser marking technique known as a technique that can form an image with a higher readability than embossing forms an image on the container body 10 by laser light after bottle molding (for example, see Japanese Unexamined Patent Application Publication No. 2011-11819). FIG. 4 illustrates an example of a label-less PET bottle drink obtained by the laser marking technique. The label-less PET bottle drink of FIG. 4 has no label 30, because an image is directly formed on a region 40 of the container body 10 thereof by laser light.

However, because these label-less techniques form images that hitherto have been printed on labels directly on the container body 10 of containers, a sufficient readability of the images may not be obtained depending on the kinds of the container body or of the images. For example, when the container body 10 is transparent like PET bottles, image readability is affected by the content of the bottles and the surrounding environment such as the background brightness, and the image may be hardly read depending on conditions. Particularly, when images that need a high readability such as barcodes are formed, the problem described above becomes prominent and may obstruct, for example, product sales.

Hence, there is a need for a technique for forming a part of an image, particularly an image that needs a high readability such as a barcode not on the container body 10 but on the cap 20 of a container that is opaque and less likely to be affected by the content and the environment.

Figure 5A:
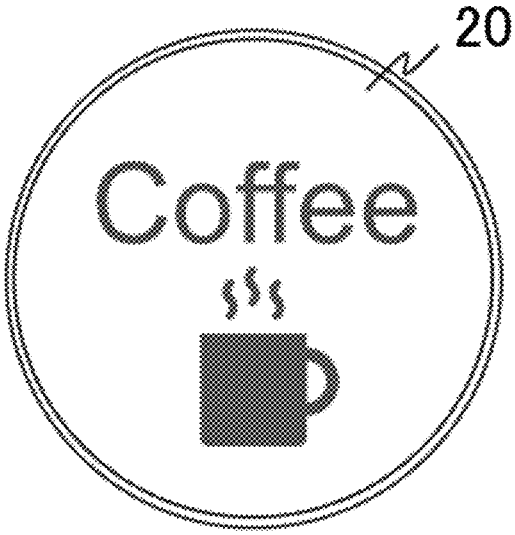
FIG. 5A is a view illustrating an existing example in which an image is formed on the top surface of a cap of a container, where letters and graphics are formed.
Figure 5B:
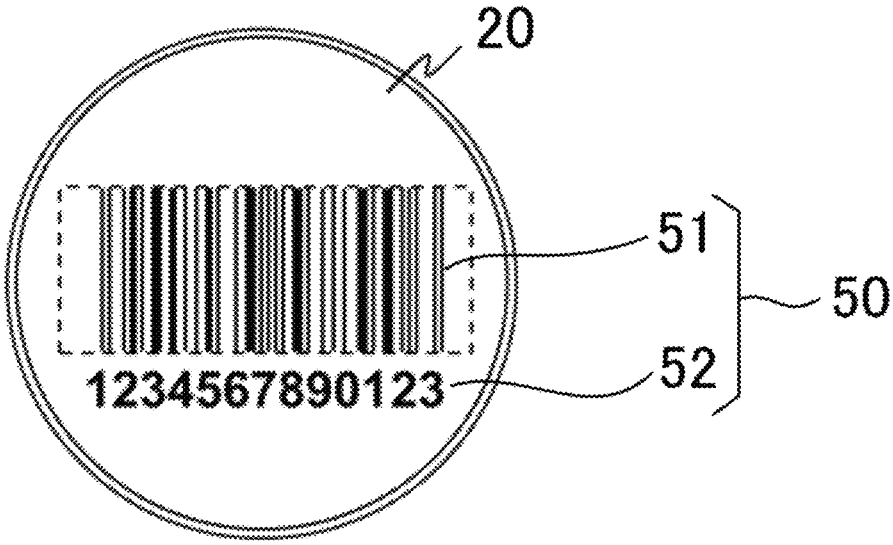
FIG. 5B is a view illustrating an existing example in which an image is formed on the top surface of a cap of an existing container, where a barcode is formed.

The existing technique of Japanese Patent No. 4532259 for forming an image on a cap of a container forms an image on the top surface of an opaque cap of a container, and can obtain a high readability of the image more stably than when forming an image on the container body. However, when forming an image that hitherto has been formed on the container body on the top surface of the cap, there is a problem that no space becomes available for forming, for example, a product name, a product logo, or a brand logo of a manufacturer that hitherto has been printed on the top surface of the cap. FIG. 5A illustrates an existing example of a cap of a container, with a product name and a product logo formed. FIG. 5B illustrates an example in which a barcode 50 as an example of an image is formed on the top surface of a cap of a container. It can be seen from FIG. 5B that there is no space available for providing a product name and a product logo on the top surface of the cap of a container, because the space is occupied by the barcode 50.

Figure 6:
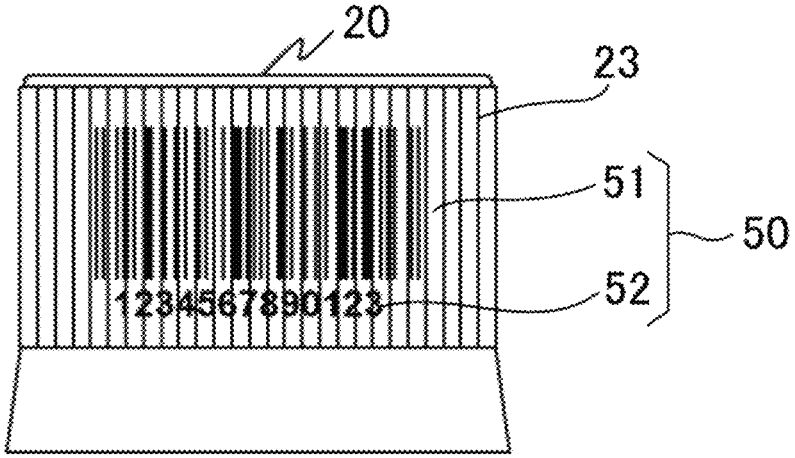
FIG. 6 is a schematic view illustrating an example in which a barcode as an image is formed on the side surface of a cap of an existing container.

As another method for overcoming the problem described above, a method of forming an image on the side surface of a cap of a container is conceivable. However, as a result of studies, the present inventor has found that an image formed on the side surface of a cap of a container may be difficult to read due to the influences of the boss and recess profile and the curvature of the side surface of the cap of a container. For example, it was found that a barcode 50 formed on the side surface of the cap 20 of a container as illustrated in FIG. 6 cannot be read well because a pattern 51 of the barcode is distorted by the boss and recess profile 23 of the side surface of the cap 20 of a container. It was also found that a barcode formed on the side surface of a container cap 20 having a small diameter like caps of drink PET bottles cannot be read well because the curvature of the side surface of such a cap 20 of a container is large and a pattern of the barcode more apart from the center in the circumferential direction is more distorted.

As obvious from the above, when an image is formed on the side surface of a cap of a container, the image is less likely to be affected by the content and the environment because the cap is opaque, but there is a problem that a sufficient image readability cannot be obtained due to the influences of the boss and recess profile and the curvature of the side surface of the cap of a container.

Hence, as a result of conducting earnest studies in order to overcome the problems described above, the present inventor has invented a cap of a container, a container and a content containing body, a method for producing a container and a container producing apparatus, and a method for producing a content containing body and a content containing body producing apparatus of the present disclosure. In the following description, a cap of a container, a container and a content containing body, a method for producing a container and a container producing apparatus, and a method for producing a content containing body and a content containing body producing apparatus of the present disclosure will be described below.

(Cap of Container)

A cap of a container of the present disclosure is a cap of a container, with an image formed on the cap.

In the first embodiment, the cap of a container includes a first part that is separated from a container body of the container when the cap is opened, and a second part that remains on the container body of the container when the cap is opened. The image is formed on a region straddling both a side surface of the first part and a side surface of the second part.

In the second embodiment, the cap of a container includes a first part that is separated from a container body of the container when the cap is opened. The first part has a region having a smooth surface on at least a part of a side surface of the first part. The image is formed on the region having a smooth surface.

In the third embodiment, the cap of a container includes a first part that is separated from a container body of the container when the cap is opened, and a second part that remains on the container body of the container when the cap is opened. The image is formed dividedly on a plurality of portions of a side surface of the second part.

Here, the image includes, for example, letters, symbols, graphics, pictures, and codes. Specifically, the image represents information such as a name, ingredients, an identification number, a name of a manufacturer, a date of manufacture, a best-by date, a barcode, a QR code (registered trademark), a recycle mark, or a logo mark.

In the present disclosure, the image is formed on a region of the side surface of the cap of a container, the region including the second part having a smooth surface. For example, when forming a barcode, which is an example of an image that needs a high readability, the pattern of the barcode is formed on the side surface of the second part having a smooth surface, and visible letters of the barcode are formed on the side surface of the first part having a boss and recess profile. In this case, because the side surface of the second part has a smooth surface, the pattern of the barcode is not distorted by a boss and recess profile. As a result, the cap of a container has a high readability even when the image is formed on the side surface of the cap.

In an aspect of the present disclosure, the cap of a container according to the first embodiment has an image, which is an identification code including: a pattern represented by combination of a dark color portion and a bright color portion; and visible letters represented by letters that can be visibly observed. The pattern of the identification code is formed on the side surface of the second part, and the visible letters of the identification code is formed on the side surface of the first part. Because the pattern that needs a high readability is formed on the side surface of the second part having a smooth surface, a high readability is obtained. Moreover, because the visible letters are formed on the first part having a boss and recess profile on the surface, an area needed for forming a barcode can be secured.

In an aspect of the present disclosure, the cap of a container according to the second embodiment includes a first part that is separated from a container body of the container when the cap is opened, the first part has a region having a smooth surface in at least a part of the side surface of the first part, and an image is formed on the region having a smooth surface. Therefore, a high readability is obtained.

In an aspect of the present disclosure, the cap of a container according to the third embodiments includes a first part that is separated from a container body of the container when the cap is opened, and a second part that remains on the container body of the container when the cap is opened, and an image is formed dividedly on a plurality of portions of the side surface of the second part. Therefore, a high readability is obtained.

In another aspect of the present disclosure, the cap of a container according to the first to third embodiments has an image, which is an identification code including a pattern represented by combination of a dark color portion and a bright color portion, and the image is formed in a manner that the width, in the circumferential direction, of a minimum unit of the pattern of the identification code is greater as the minimum unit is more apart from the center of the pattern in the circumferential direction. Therefore, when the pattern is read with a reader, the minimum units of the pattern are perceived by a constant reading width regardless of the distance from the center. As a result, even when there is a curvature as there is on the side surface of a cap of a container, image distortion due to the curvature can be reduced. Therefore, image readability is improved.

For example, the material, shape, size, structure, and color of the cap of a container are not particularly limited and may be appropriately selected depending on the intended purpose.

The material of the cap of a container is not particularly limited and may be appropriately selected depending on the intended purpose. Examples of the material of the cap of a container include resins, glass, metals, and ceramic. Among these materials, resins are preferable in terms of moldability.

Examples of the resins of the cap of a container include polyvinyl alcohol (PVA), polybutylene adipate/terephthalate (PBAT), polyethylene terephthalate succinate, polyethylene (PE), polypropylene (PP), polyethylene terephthalate (PET), vinyl chloride (PVC), polystyrene (PS), polyurethane, epoxy, biopolybutylene succinate (PBS), polylactic acid blend (PBAT), starch blended polyester resins, polybutylene terephthalate succinate, polylactic acid (PLA), polyhydroxy butyrate/hydroxyhexanoate (PHBH), polyhydroxyalkanoic acid (PHA), bio PET 30, biopolyamide (PA) 610, 410, 510, bio PA1012, 10T, bio PA11T, MXD10, biopolycarbonate, biopolyurethane, bio PE, bio PET100, bio PA11, and bio PA1010. One of these resins may be used alone or two or more of these resins may be used in combination. Among these resins, biodegradable resins such as polyvinyl alcohol, polybutylene adipate/terephthalate, and polyethylene terephthalate succinate are preferable in terms of environmental impacts.

Examples of the color of the cap of a container include opaque colors and transparent colors. Among these colors, opaque colors are preferable in terms of image readability.

The shape and size of the cap of a container are not particularly limited and may be appropriately selected depending on the intended purpose so long as the opening of a container body can be sealed (closed) by the shape and size.

The structure of the cap of a container is not particularly limited and may be appropriately selected depending on the intended purpose. It is preferable that the cap of a container include a first part that is separated from a container body when the cap is opened, and a second part that remains on the container body when the cap is opened.

It is preferable that the side surface of the first part have a boss and recess profile on the surface in order that a hand may not slip when opening the cap. It is preferable that the side surface of the second part not have a boss and recess profile, but have a flat surface.

The embodiments of the cap of a container of the present disclosure will be described in detail below with reference to the drawings. In the drawings, the same components will be denoted by the same reference numerals, and may not be described repeatedly. For example, the numbers, positions, and shapes of the components are not limited to the embodiments, but may be any numbers, positions, and shapes that are suitable for carrying out the present disclosure.

First Embodiment of the Cap of a Container

In the first embodiment of the cap of a container, an image is formed on the side surface of the cap of a container, the side surface straddling both a first part that is separated from a container body of the container when the cap is opened, and a second part that remains on the container body of the container when the cap is opened.

Figure 7:
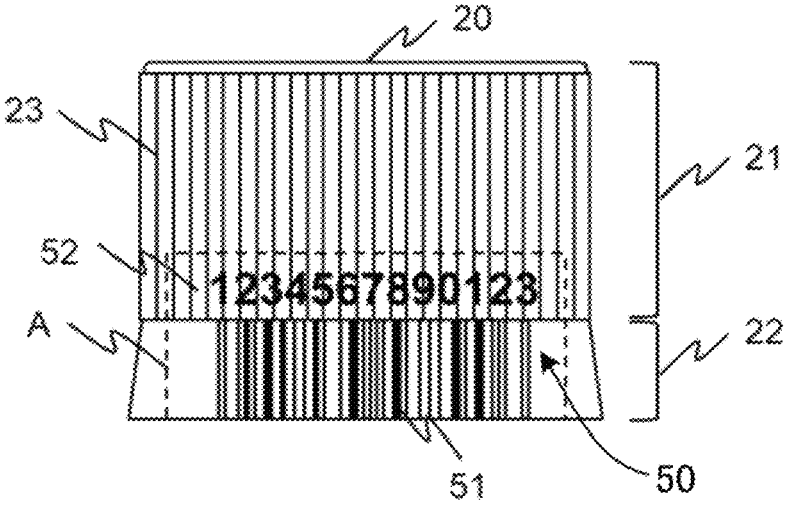
FIG. 7 is a schematic view illustrating an example of a cap of a container according to a first embodiment.

FIG. 7 is a view illustrating an example of a cap 20 of a container according to the first embodiment. The cap 20 of a container according to the first embodiment includes a first part 21 that is separated from a container body of the container when the cap is opened, and a second part 22 that remains on the container body of the container when the cap is opened. The side surface of the first part 21 has a boss and recess profile 23 on the surface in order that a hand may not slip when opening the cap. The side surface of the second part 22 has no boss and recess profile 23 but has a smooth surface. Here, "smooth" means that bosses and recesses on the surface are smaller than those on the side surface of the first part 21. It is not indispensable that the side surface of the second part 22 be smooth all around. So long as a portion on which an image is to be formed is smooth, other portions of the side surface of the second part 22 may have a boss and recess profile 23.

In the cap 20 of a container according to the first embodiment, an image is formed on a region A of the side surface, the region A straddling both the first part 21 and the second part 22 (i.e., on a region enclosed within a dotted line). FIG. 7 illustrates an example in which a barcode 50, which is an example of the image, is formed. The barcode 50 is formed of a pattern 51 of the barcode represented by combination of bars (illustrated by black in FIG. 7), which are dark color portions, and spaces (illustrated by white in FIG. 7), which are bright color portions; and visible letters 52 of the barcode represented by letters that can be visibly observed. The pattern 51 of the barcode is formed on the side surface of the second part 22 in a fence-like formation (in a direction in which the bars are perpendicular to the top surface of the cap). The visible letters 52 of the barcode are formed on the side surface of the first part 21.

Figure 8A:
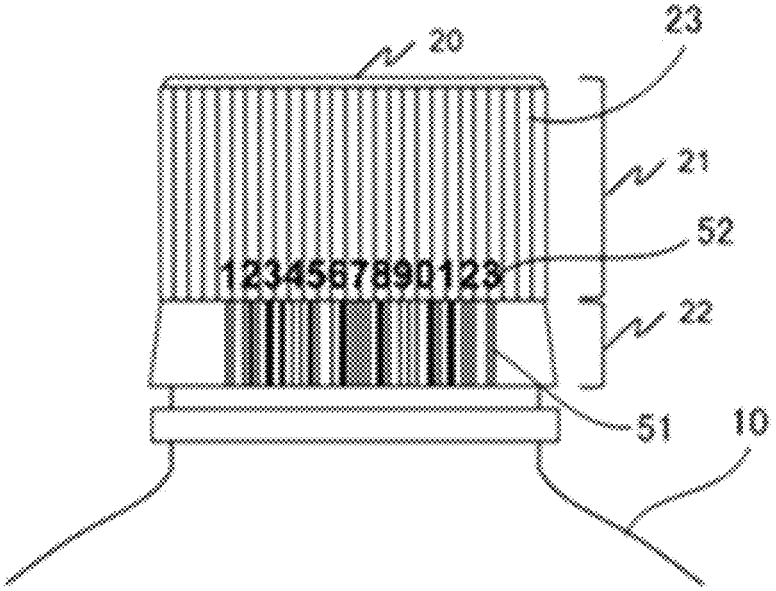
FIG. 8A is a view illustrating an example of a state when the cap of a container according to the first embodiment is attached on the container.
Figure 8B:
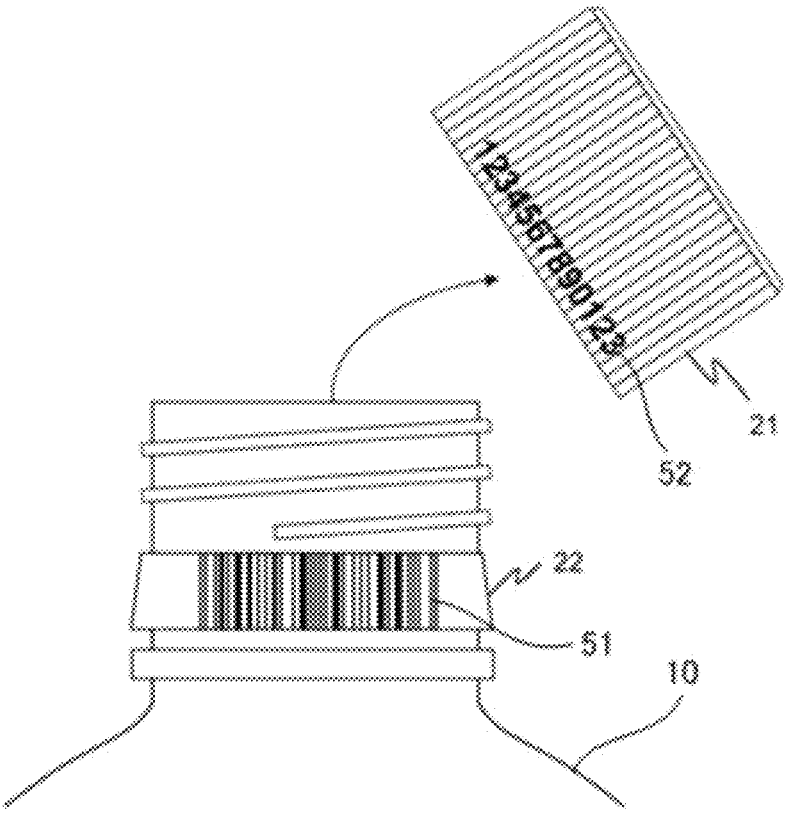
FIG. 8B is a schematic view illustrating an example of a state when the cap of a container according to the first embodiment is opened from the container.

FIG. 8A illustrates a state that the cap 20 of a container according to the first embodiment is attached on a container body 10 of the container. FIG. 8B illustrates a state that the cap is opened. When the cap is opened, the pattern 51 of the barcode formed on the side surface of the second part 22 remains on the container body 10 of the container, and the visible letters 52 of the barcode formed on the first part 21 are separated from the container body 10 of the container.

In the cap 20 of a container according to the first embodiment, an image is formed on a region including the second part 22 having no boss and recess profile 23. Because it does not occur in the second part 22 that the image is distorted by a boss and recess profile 23, a high readability of the image is obtained even though the image is formed on the side surface of the cap 20 of a container.

In the cap 20 according to the first embodiment, an image is formed on a region including not only the second part 22 but also the first part 21. Therefore, an image having a size that cannot be contained only within the second part 22 can be formed. For example, for a JAN code, which is a barcode widely used in daily necessities in general, it is stipulated that the height of the bars of the pattern 51 of the barcode be 9 mm or greater even when the bars are truncated (truncation means reducing the height of the bars when a printing space cannot be secured). It is also necessary to display the visible letters 52 of the barcode in combination. In this regard, the side surface of the second part 22 typically has a height of 9 mm or less, so the pattern 51 and the visible letters 52 of the barcode cannot be formed at the same time. Even such a barcode 50 can be formed on the cap 20 of a container according to the first embodiment, as illustrated in FIG. 7. That is, by forming the pattern 5 of the barcode that needs a high readability on the side surface of the second part 22 and forming the visible letters 52 of the barcode on the side surface of the first part 21, it is possible to fully display the barcode 50 while securing a high readability of the pattern 51 of the barcode.

In the cap 20 of a container according to the first embodiment, the pattern 51 of the barcode is formed on the side surface of the second part 22 that remains on the container body 10 of the container when the cap is opened. Therefore, even if the first part 21 separated from the container body 10 of the container has got lost or is exchanged with a cap of another container, it is possible to confirm the information of the intended product by reading the pattern 51 of the barcode on the second part 22 that remains on the container body 10 of the container.

Figure 9:
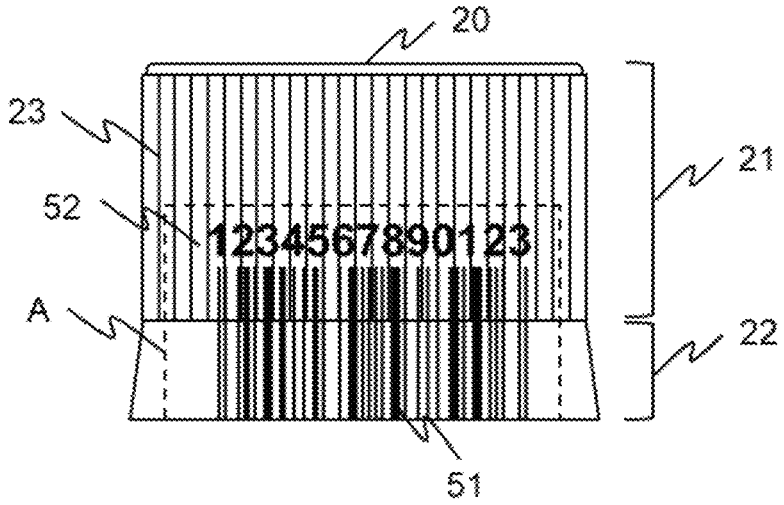
FIG. 9 is a schematic view illustrating another example of the cap of a container according to the first embodiment.

The pattern 51 of the barcode needs not necessarily be formed only on the second part 22, but may be formed on a region straddling both the second part 22 and the first part 21 as illustrated in FIG. 9. Also in this case, a high readability can be obtained so long as the pattern 51 of the barcode formed on the second part 22 is read.

It is preferable to form the pattern 51 of the barcode in a manner that the width of a minimum unit of the pattern 51 of the barcode (e.g., a module of a JAN code) in the circumferential direction of the cap 20 of a container is greater as the minimum unit is more apart from the center of the pattern 51 of the barcode in the circumferential direction. This will be described with reference to an example of a simplified pattern 51 of a barcode in which bars and spaces, which are minimum units, are arranged alternately as illustrated in FIG. 10.

Figure 10:
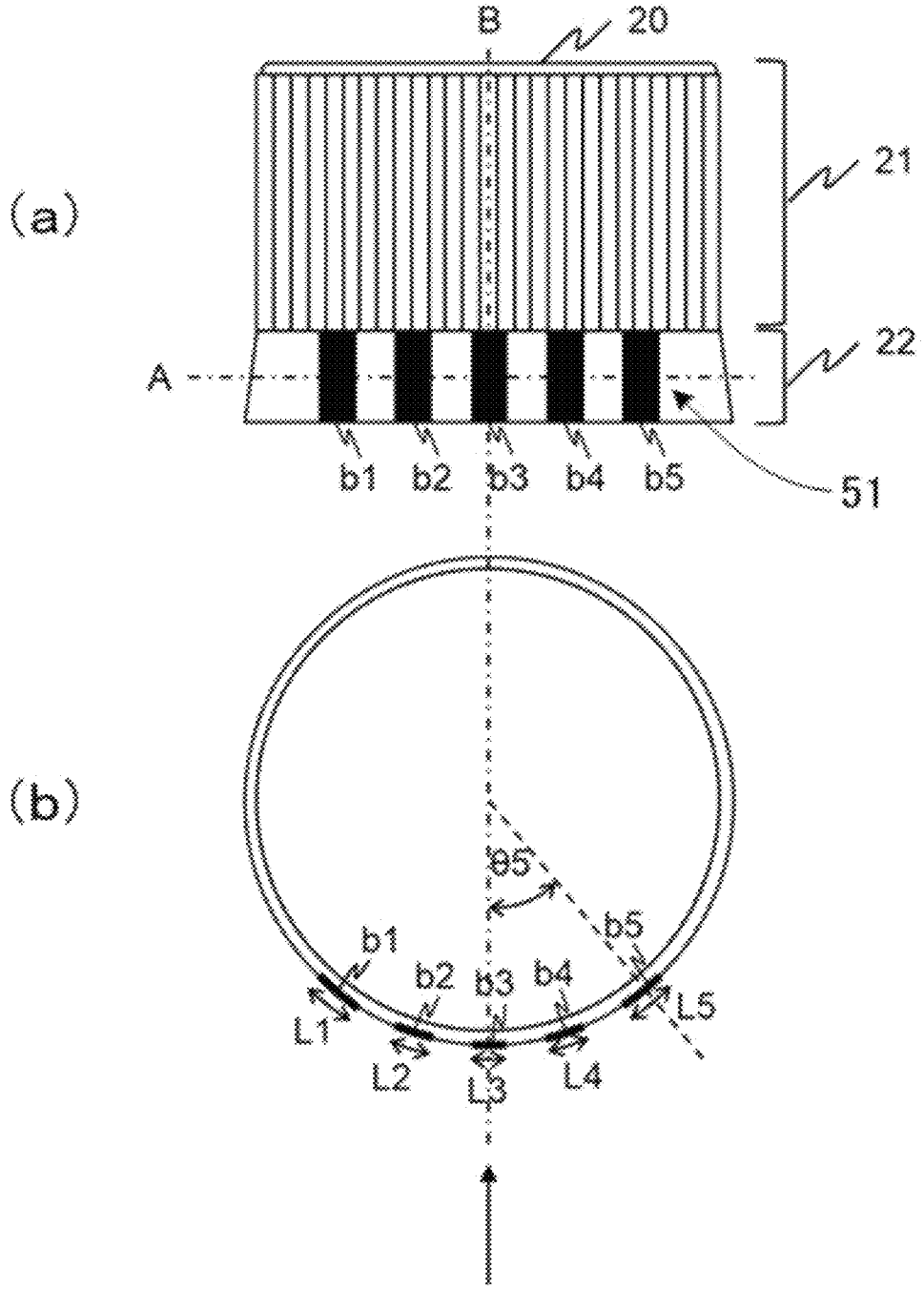
FIG. 10 illustrates a side view of a cap on which a barcode pattern is formed in (a) and a top view of a cross-section of the cap in (b)

FIG. 10 illustrates a side view of the cap 20 of a container, with the pattern 51 of the barcode formed on the cap 20 in (a), and a top view of a cross-section A of the cap 20 of a container in (b). The bars b1 to b5 are formed in a manner that the widths L1 to L5 of the bars b1 to b5 in the circumferential direction are greater as the bars b1 to b5 are more apart from the center line B of the pattern 51 of the barcode, i.e., in a manner that the following formula: $L3<L2$, $L4<L1$, $L5$ is satisfied. More specifically, it is preferable to form the bars b1 to b5 in a manner that the following formula: $L(\theta)=L(0)/\cos\theta$ is satisfied, where $L(0)$ represents the width, in the circumferential direction, of a minimum unit present in the center of the pattern 51 of the barcode, and $L(\theta)$ ($\theta<\pi/2$) represents the width, in the circumferential direction, of a minimum unit present at a position apart from the center of the pattern 51 of the barcode by an angle $\theta$.

For example, the width L5 of the bar b5 in the circumferential direction is expressed by $L5=L(\theta5)=L(0)/\cos\theta5=L3/\cos\theta5$. Here, because $\cos\theta5<1$ is satisfied, $L5>L3$ is satisfied.

When the pattern 51 of the barcode is formed in this way, the minimum units of the pattern 51 of the barcode are perceived by a constant reading width regardless of the distance from the center, when the pattern 51 of the barcode is read with a barcode reader from a position along the center line B (from a barcode reading position indicated by a longitudinal arrow in (b) of FIG. 10). As a result, even when there is a curvature as there is on the side surface of the cap 20 of the container, a high image readability is obtained.

An example of a barcode has been described with reference to FIG. 10. The same applies to two-dimensional identification codes such as QR codes (registered trademarks). That is, when cells, which are the minimum units of the pattern 51 of the barcode, are formed in a manner that the widths of the cells in the circumferential direction of the cap 20 of a container are greater as the cells are more apart from the center of the pattern 51 of the barcode in the circumferential direction, a high readability is obtained in spite of the curvature.

Figure 11:
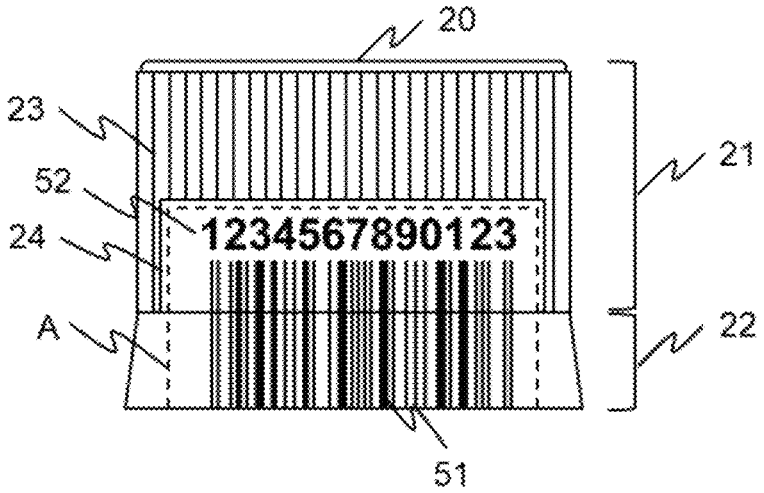
FIG. 11 is a schematic view illustrating an example of a cap of a container according to a modified example 1 of the first embodiment.

FIG. 11 is a view illustrating an example of a modified example 1 of the first embodiment of the cap of a container. In the modified example 1 of the first embodiment of the cap of a container, the same components as those in the first embodiment of the cap of a container described above will be denoted by the same reference numerals and will not be described repeatedly.

A cap 20 of a container according to the modified example 1 of the first embodiment illustrated in FIG. 11 is different from the cap of a container according to the first embodiment in that a smooth region 24 is formed at a part of the side surface of the first part 21, and an image is formed on the side surface straddling both the smooth region 24 of the first part 21 and the second part 22.

It is preferable that the smooth region 24 provided on the side surface of the first part 21 have the smallest area needed for formation of an image, in order that a hand may not slip when opening the cap. Moreover, in FIG. 11, the smooth region 24 is formed in a size in which the visible letters 52 of a barcode can also be contained. However, in order to increase the area of the boss and recess profile 23, the smooth region 24 may be formed in a size in which only the pattern 51 of the barcode can be contained, and the visible letters 52 may be formed on a region having the boss and recess profile 23. Also in this case, the information stored in the pattern of the barcode can be securely read with, for example, a barcode reader because the pattern 51 of the barcode that needs a particularly high readability is formed on the smooth region.

Modified Example 2 of the First Embodiment of the Cap of a Container

Figure 12:
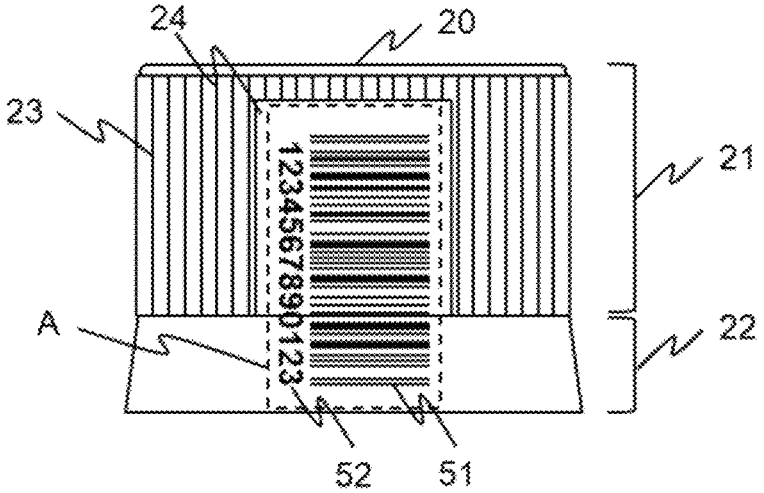
FIG. 12 is a schematic view illustrating an example of a cap of a container according to a modified example 2 of the first embodiment.

FIG. 12 is a view illustrating an example of a modified example 2 of the first embodiment of the cap of a container. In the modified example 2 of the first embodiment of the cap of a container, the same components as those in the first embodiment of the cap of a container described above will be denoted by the same reference numerals and will not be described repeatedly.

A cap 20 of a container according to the modified example 2 of the first embodiment illustrated in FIG. 12 is different from the cap of a container according to the first embodiment in that a smooth region 24 is formed at a part of the side surface of the first part 21, and a barcode 50, which is an example of an image, is formed on the side surface straddling both the smooth region 24 of the first part 21 and the second part 22 in a ladder-like formation (in a direction in which the bars are parallel with the top surface of the cap). Also in this case, the information stored in the pattern of the barcode can be securely read with, for example, a barcode reader because the pattern 51 of the barcode is formed on the smooth region. Moreover, because the barcode is formed in a ladder-like formation, distortion due to the curvature of the side surface of the cap of a container can be suppressed, and a high readability can be obtained.

Second Embodiment of the Cap of a Container

The second embodiment of the cap of a container is a cap of a container and characterized in that an image is formed on a smooth region provided on the side surface of a first part that is separated from a container body of the container when the cap is opened. In the second embodiment of the cap of a container, the same components as those in the embodiment of the cap of a container described above will be denoted by the same reference numerals and will not be described repeatedly.

Figure 13:
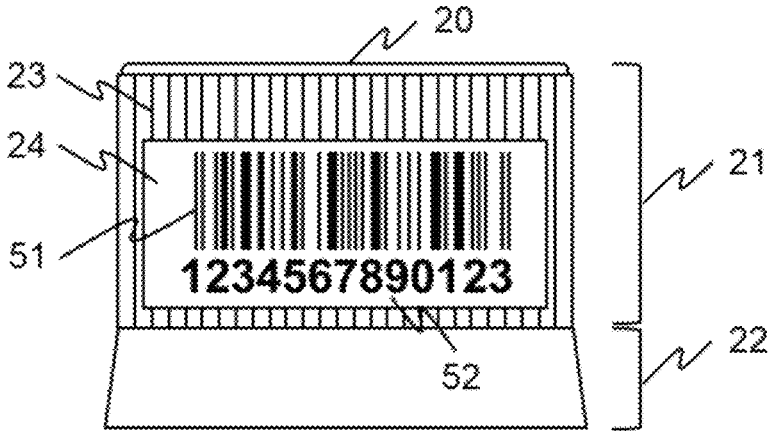
FIG. 13 is a schematic view illustrating an example of a cap of a container according to a second embodiment.

FIG. 13 is a view illustrating an example of the cap of a container according to the second embodiment. A cap 20 of a container according to the second embodiment includes a first part 21 that is separated from a container body of the container when the cap is opened and a second part 22 that remains on the container body of the container when the cap is opened. The first part 21 has a region 24 having a smooth surface at a part of the side surface of the cap of a container. "Smooth" means that bosses and recesses on the surface are smaller than those on a region having a boss and recess profile 23. The first part 21 has a boss and recess profile 23 on the surface other than the smooth region 24, in order that a hand may not slip when opening the cap. The side surface of the second part 22 has no boss and recess profile but has a smooth surface. The second part 22 is not an indispensable component, and may be omitted. The surface of the side surface of the second part 22 needs not necessarily be smooth, and may have a boss and recess profile like the first part 21.

The cap 20 of a container according to the second embodiment is characterized in that an image is formed on the smooth region 24 of the first part 21. FIG. 13 illustrates an example in which a barcode, which is an example of an image, is formed. FIG. 13 illustrates an example in which a pattern 51 of the barcode is formed in a fence-like formation (in a direction in which the bars are perpendicular to the top surface of the cap). However, when the pattern 51 of the barcode can be contained within the side surface of the first part 21, the pattern 51 of the barcode may be formed in a ladder-like formation (in a direction in which the bars are parallel with the top surface of the cap). FIG. 13 illustrates an example in which visible letters 52 of the barcode are formed below the pattern 51 of the barcode. However, the visible letters 52 of the barcode may be formed on any other position such as above the pattern 51 of the barcode, so long as the position is near the pattern of the barcode.

In the cap 20 of a container according to the second embodiment, an image is formed on the smooth region 24 provided on a partial region of the side surface of the first part 21. Because it does not occur in the smooth region 24 that the image is distorted by a boss and recess profile, a high readability can be obtained even though the image is formed on the side surface of the cap of a container.

It is preferable that the smooth region 24 provided on the side surface of the first part 21 have the smallest area needed for formation of an image in order that a hand may not slip when opening the cap. It is also preferable to form the pattern 51 of the barcode in a manner that the width of a minimum unit of the pattern in the circumferential direction of the cap 20 of a container is greater as the minimum unit is more apart from the center of the pattern 51 of the barcode in the circumferential direction, like the cap of a container according to the first embodiment.

Figure 14:
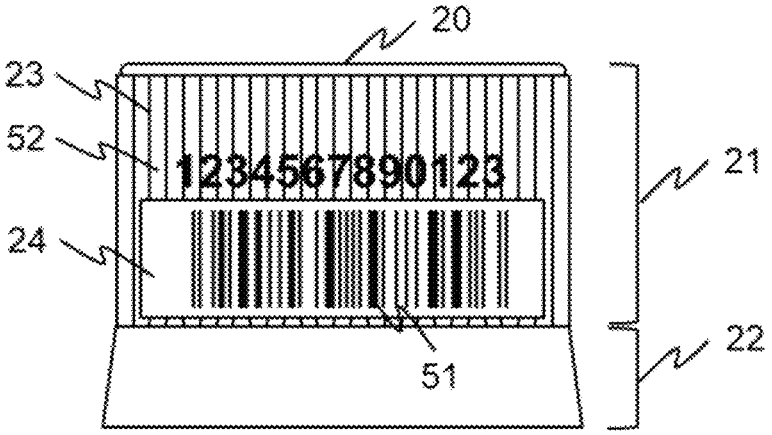
FIG. 14 is a schematic view illustrating another example of the cap of a container according to the second embodiment.

As illustrated in FIG. 14, the visible letters 52 of the barcode may be formed on a region of the first part 21 having a boss and recess profile 23. This makes it possible to reduce the area of the smooth region 24 and make a hand less likely to slip when opening the cap.

Third Embodiment of the Cap of a Container

The third embodiment of the cap of a container is a cap of a container and characterized in that images are formed dividedly on a plurality of portions of the side surface of a second part that remains on a container body of the container when the cap is opened. In the third embodiment of the cap of a container, the same components as those in the embodiments of the cap of a container described above will be denoted by the same reference numerals and will not be described repeatedly.

Figure 15A:
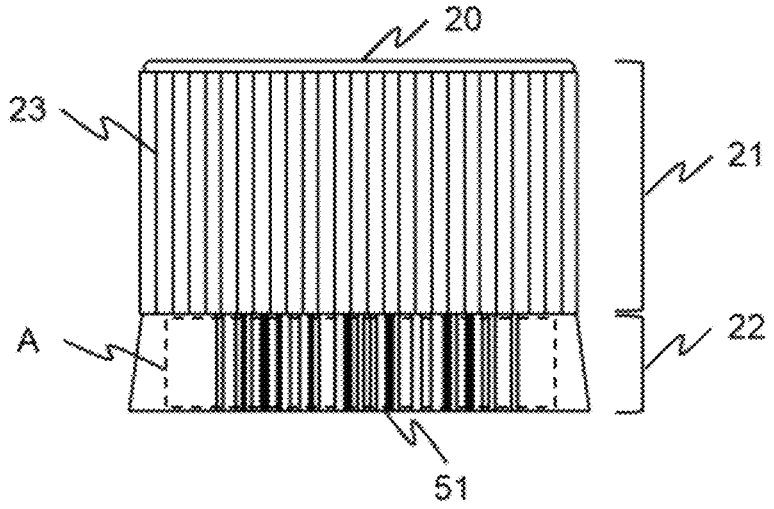
FIG. 15A is a schematic view of a side surface of a cap of a container according to a third embodiment, seen from one position.
Figure 15B:
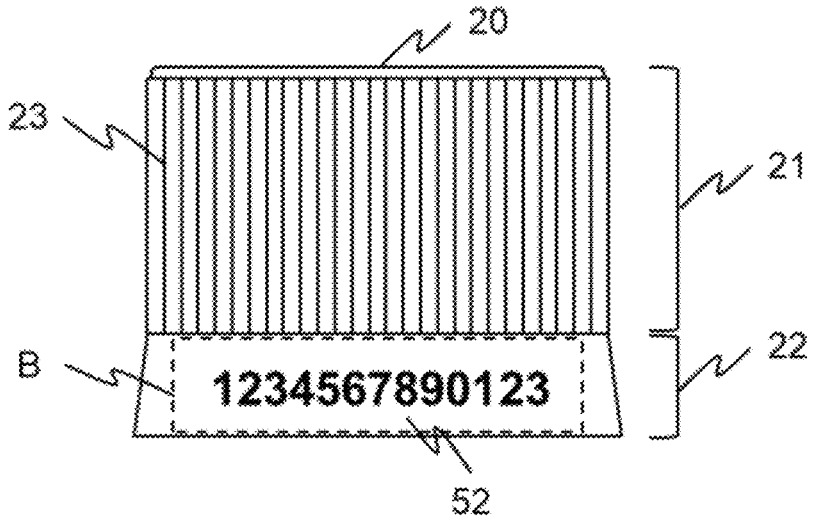
FIG. 15B is a schematic view of the side surface of the cap of a container according to the third embodiment, seen from a different position from FIG. 15A.

FIG. 15A and FIG. 15B are views illustrating an example of the cap 20 of a container according to the third embodiment. FIG. 15A is a view of the side surface of the cap 20 of a container seen from one position, and FIG. 15B is a view of the side surface of the cap 20 of a container seen from a different position from FIG. 15A. The formations of the first part 21 and the second part 22 are the same as in the cap of a container according to the first embodiment. In the cap 20 of a container according to the third embodiment, images are formed on a plurality of portions of the side surface of the second part 22. FIG. 15A and FIG. 15B illustrate an example in which a barcode, which is an example of an image, is formed. Dividedly, a pattern 51 of the barcode is formed on a region A of the second part 22 as illustrated in FIG. 15A, and visible letters 52 of the barcode are formed on a region B of the second part 22 shifted from the region A in the circumferential direction as illustrated in FIG. 15B.

As described above, the side surface of the second part 22 typically has height of 9 mm or less, and the pattern 51 and the visible letters 52 of the barcode cannot be formed at the same time. However, by forming the pattern 51 and the visible letters 52 of the barcode dividedly on different regions as illustrated in FIG. 15A and FIG. 15B, it is possible to confine the pattern 51 and the visible letters 52 of the barcode within the side surface of the second part 22. Because the second part 22 has a smooth surface, a high readability can be obtained even though the image is formed on the side surface of the cap of a container.

It is preferable to form the pattern 51 of the barcode in a manner that the width of a minimum unit of the pattern 51 of the barcode in the circumferential direction of the cap 20 of a container is greater as the minimum unit is more apart from the center of the pattern 51 of the barcode in the circumferential direction, like the cap of a container according to the first embodiment. In this way, a high readability can be obtained even when there is a curvature as there is on the side surface of a cap of a container.

(Method for Producing a Cap of a Container and Container Cap Producing Apparatus)

A method for producing a cap of a container of the present disclosure is a method for producing the cap of a container of the present disclosure, and includes a first irradiation step and further includes other steps as needed.

A container cap producing apparatus of the present disclosure is an apparatus configured to produce the cap of a container of the present disclosure, and includes a first irradiation unit and further includes other units as needed.

Needless to say, the method for producing a cap of a container and the container cap producing apparatus of the present disclosure can form an image on a cap separated from a container. However, in terms of operability and working efficiency, it is preferable to form an image on a cap of a container that is completed as a container with the cap of a container attached on a container body of the container, or on a cap of a container that is completed as a content containing body with a content contained in the container.

<First Irradiation Unit and First Irradiation Step>

The first irradiation step is a step of irradiating a side surface of a cap of a container with laser light to form an image, and is performed by the first irradiation unit.

The first irradiation unit includes a laser light source.

The laser light source is not particularly limited and may be appropriately selected depending on the intended purpose. For example, a fiber laser configured to emit laser light is preferable. However, the laser light source is not limited to a fiber laser, but various laser light sources may be used. The laser light emitted by the laser light source may be pulsed light or continuous light. A laser light source that can oscillate pulsed light having a time width shorter than a nanosecond is preferable in terms of, for example, peak energy.

(Container)

A container of the present disclosure includes a cap of a container and a container body.

<Cap of a Container>

As the cap of a container, the cap of a container of the present disclosure described above is used.

<Container Body>

For example, the material, shape, size, structure, and color of the container body are not particularly limited and may be appropriately selected depending on the intended purpose.

The material of the container body is not particularly limited and may be appropriately selected depending on the intended purpose. Examples of the material of the container body include resins, glass, metals, and ceramic. Among these materials, resins or glass are preferable, transparent resins or transparent glass are more preferable, and transparent resins are particularly preferable.

Examples of the resins of the container body include polyvinyl alcohol (PVA), polybutylene adipate/terephthalate (PBAT), polyethylene terephthalate succinate, polyethylene (PE), polypropylene (PP), polyethylene terephthalate (PET), vinyl chloride (PVC), polystyrene (PS), polyurethane, epoxy, biopolybutylene succinate (PBS), polylactic acid blend (PBAT), starch blended polyester resins, polybutylene terephthalate succinate, polylactic acid (PLA), polyhydroxybutyrate/hydroxyhexanoate (PHBH), polyhydroxyalkanoic acid (PHA), bio PET30, biopolyamide (PA) 610, 410, 510, bio PA1012, 10T, bio PA11T, MXD10, biopolycarbonate, biopolyurethane, bio PE, bio PET100, bio PA11, and bio PA1010. One of these resins may be used alone or two or more of these resins may be used in combination. Among these resins, biodegradable resins such as polyvinyl alcohol, polybutylene adipate/terephthalate, and polyethylene terephthalate succinate are preferable in terms of environmental impacts.

The shape of the container body is not particularly limited and may be appropriately selected depending on the intended purpose. Examples of the shape of the container body include a bottle shape, a circular columnar shape, a quadrangular prismatic shape, a box shape, and a pyramidal shape. Among these shapes, a bottle shape s preferable.

The container body having a bottle shape includes an opening portion, a shoulder portion joined to the opening portion, a trunk portion joined to the shoulder portion, and a bottom portion joined to the trunk portion.

The size of the container body is not particularly limited and may be appropriately selected depending on the use of the container.

The structure of the container body is not particularly limited and may be appropriately selected depending on the intended purpose. For example, the container body may have a single-layer structure or a multilayer structure.

Examples of the color of the container body include a colorless transparent color, transparent colors, and opaque colors. Among these colors, a transparent colorless color is preferable.

The embodiments of the container of the present disclosure will be described in detail below with reference to the drawings. In the drawings, the same components will be denoted by the same reference numerals, and may not be described repeatedly. For example, the numbers, positions, and shapes of the components described below are not limited to the embodiments described below, and may be any numbers, positions, and shapes suitable for carrying out the present disclosure.

First Embodiment of Container

The first embodiment of the container is a container including a cap. As the cap, the cap of a container according to any of the first to third embodiments described above is used.

Figure 16:
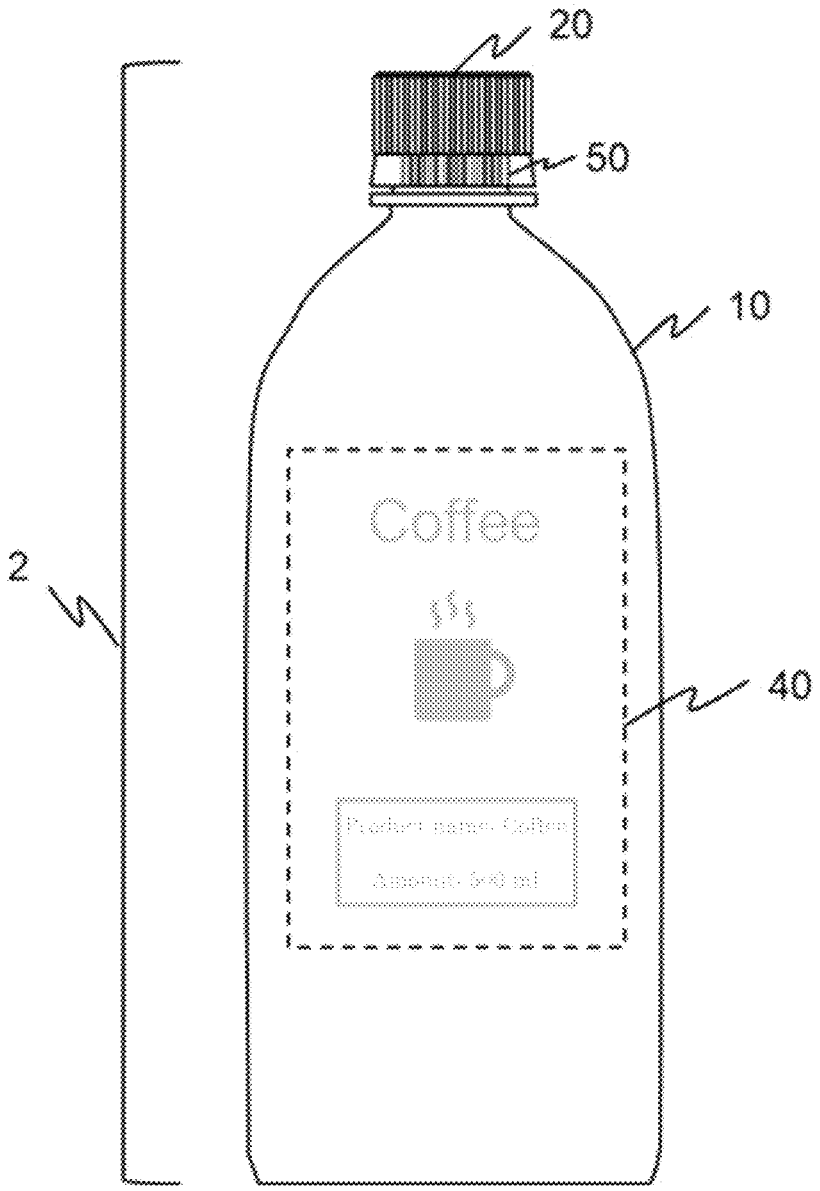
FIG. 16 is a schematic view illustrating an example of a container according to a first embodiment.

FIG. 16 is a view illustrating an example of the container according to the first embodiment. A container 2 according to the first embodiment includes a container body 10 and a cap 20 of a container.

The container body 10 is a container that can contain a content such as a drink inside, and is, for example, a colorless transparent bottle (PET bottle) obtained by molding polyethylene terephthalate (PET) as a material. The container body 10 may be a container other than a PET bottle so long as a content can be contained inside. For example, the container body 10 may be a bottle obtained by molding any other resin than PET, a glass bottle, a metallic can, and a ceramic container. The color of the container body 10 may be any other color than a colorless transparent color, and may be, for example, a transparent color or an opaque color.

As illustrated in FIG. 16, an image representing, for example, product information such as a product name, a product logo, and ingredients and an amount of the drink may be formed on the container body 10 by such methods as laser marking or embossing.

The cap 20 of a container is the cap described in any of the first to third embodiments of the cap of a container, and characterized in that an image having a high readability is formed on the side surface of the cap.

Here, among images to be formed on the container, any image that needs a high readability prefers being formed on the side surface of the cap 20 of a container to being formed on the container body 10. An image that needs a high readability is an identification code such as a barcode or a QR code (registered trademark). Particularly, a barcode is an image that must be displayed on a product when the product is put on sale, and must have a high readability so that the pattern can be securely read with a barcode reader.

Existing techniques for forming a barcode on the container body of a container by laser marking or embossing have a problem that the images are hard to read depending on the content or the environmental conditions such as the background brightness. Here, the container according to the first embodiment has a barcode on the side surface of the cap of a container according to any of the first to third embodiments. Therefore, a high readability can be obtained regardless of the content and the reading environment. Moreover, because the barcode is formed on the side surface of the cap of a container, an image representing, for example, a product name, a product logo, or a brand logo of a manufacturer hitherto printed on the top surface of a cap of a container can be formed on the top surface of the cap of a container as it has been.

Hence, using the container according to the first embodiment, it is possible to provide a label-less product.

(Content Containing Body)

A content containing body of the present disclosure includes a container and a content contained in the container.

<Container>

As the container, the container of the present disclosure described above can be used.

<Content>

Examples of the content include drinks, powders, and gases. When the content is a drink such as water, coffee, and tea, the content often has a color, such as a colorless color, black, brown, or yellow.

The embodiments of the content containing body of the present disclosure will be described in detail below with reference to the drawings. In the drawings, the same components will be denoted by the same reference numerals, and may not be described repeatedly. For example, the numbers, positions, and shapes of the components are not limited to the embodiments, but may be any numbers, positions, and shapes that are suitable for carrying out the present disclosure.

First Embodiment of Content Containing Body

The first embodiment of the content containing body is a content containing body formed of; a container including a cap; and a content contained in the container. The container is the container according to the first embodiment described above, and characterized in that an image having a high readability is formed on the side surface of the cap of the container.

Figure 17:
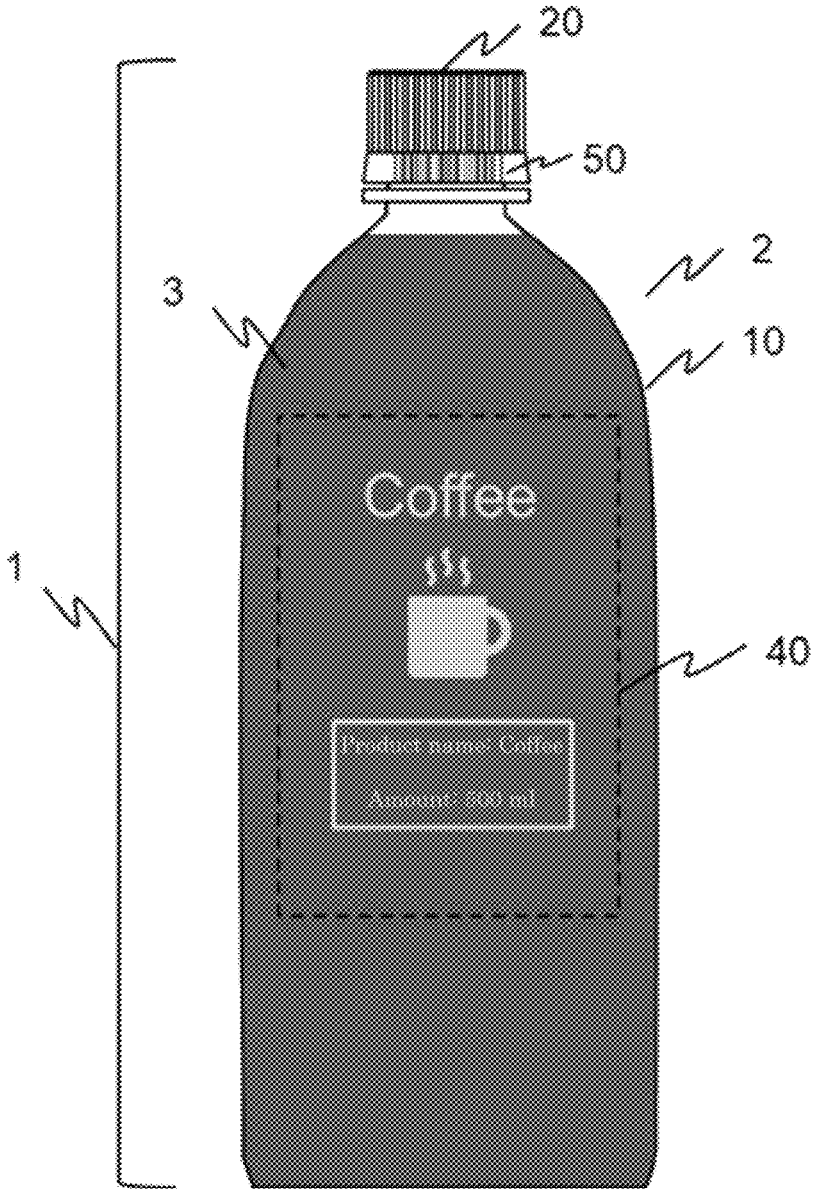
FIG. 17 is a schematic view illustrating an example of a container according to a second embodiment.

FIG. 17 is a view illustrating a PET bottle drink, which is an example of a content containing body 1 according to the first embodiment. A container 2 is the container according to the first embodiment, and is a PET bottle. A cap 20 of the container is the cap of a container according to any of the first to third embodiments, and has a barcode, which is an example of an image, on the side surface of the cap 20. As illustrated in FIG. 17, an image representing, for example, product information such as a product name, a product logo, and ingredients and an amount of a drink is formed on the container body 10 of the container by such methods as laser marking and embossing.

A content 3 is a drink, which is an example of a content. The container 2 may be any other container so long as the any other container falls within the container according to the first embodiment. The content 3 is not limited to a drink, and may be an arbitrary content so long as it can be contained in the container.

In the content containing body 1 according to the first embodiment, a barcode is formed on the side surface of the cap of a container according to any of the first to third embodiments. Therefore, a high readability can be obtained regardless of the content or the reading environment. Moreover, because the barcode is formed on the side surface of the cap of a container, an image representing, for example, a product name, a product logo, or a brand logo of a manufacturer hitherto printed on the top surface of a cap of a container can be formed on the top surface of the cap of a container as it has been.

Hence, using the content containing body according to the first embodiment, it is possible to provide a label-less product.

(Method for Producing Content Containing Body and Content Containing Body Producing Apparatus)

A method for producing a content containing body of the present disclosure includes a step of producing a cap of a container, the step being formed of the method for producing a cap of a container of the present disclosure, preferably includes a second irradiation step of irradiating a container body with laser light to form an image, and further includes other steps as needed.

A content containing body producing apparatus of the present disclosure includes a unit configured to produce a cap of a container, the unit being formed of the container cap producing apparatus of the present disclosure, preferably includes a second irradiation unit configured to irradiate a container body with laser light to form an image, and further includes other units as needed.

The first irradiation unit and the second irradiation unit may be the same unit or different units. By the first irradiation unit forming an image on the side surface of a cap of a container and the second irradiation unit forming an image representing, for example, product information such as a product name, a product logo, and ingredients or an amount of a drink on a container body, it is possible to provide a label-less content containing body.

The embodiments of the content containing body producing apparatus of the present disclosure will be described in detail below with reference to the drawings. In the drawings, the same components will be denoted by the same reference numerals, and may not be described repeatedly. For example, the numbers, positions, and shapes of the components are not limited to the embodiments, but may be any numbers, positions, and shapes that are suitable for carrying out the present disclosure.

First Embodiment of Content Containing Body Producing Apparatus

The first embodiment of the content containing body producing apparatus includes a first irradiation unit configured to irradiate the side surface of a cap of a container with laser light to form an image, and further includes other units as needed.

Figure 18:
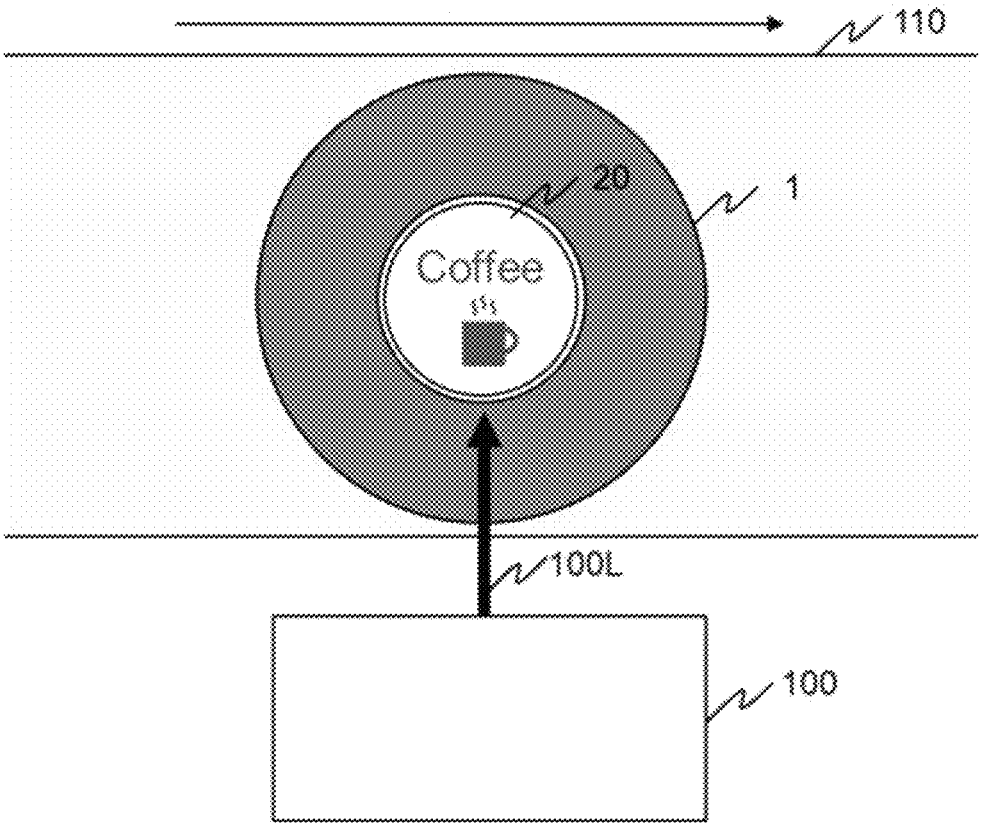
FIG. 18 is a schematic view illustrating an example of a content containing body producing apparatus according to a first embodiment.

FIG. 18 is a view illustrating how an apparatus for producing a PET bottle drink 1, which is an example of a content containing body, forms an image on the side surface of a cap 20 of a container by laser marking. The drink PET bottle 1, which is a PET bottle serving as a container and filled with a drink serving as a content, is moved by a belt conveyor 110 in the moving direction indicated by a latitudinal arrow in FIG. 18 (the same applies in FIG. 20 as to the latitudinal arrow) in a state of being sealed with the cap 20 of a container.

A laser marking device 100 serving as the first irradiation unit is installed along the line of the belt conveyor 110, and configured to irradiate the drink PET bottle 1 with laser light 100L emitted from a laser light source when the drink PET bottle 1 is passing in front of the laser marking device 100, to form an image on the side surface of the cap 20 of a container.

As the laser light source of the laser marking device 100, for example, a fiber laser can be used. The fiber laser is a laser light source utilizing an optical fiber containing a rare-earth element as a laser medium. The laser light source emits laser light 100L of a short pulse such as nanosecond. However, the laser light source is not limited to the fiber laser, but various kinds of laser light sources can be used. The laser light emitted by the laser light source may be pulsed light or continuous light. A laser light source that can oscillate pulsed light having a time width shorter than a nanosecond is preferable in terms of, for example, peak energy.

Examples of the kinds of the laser include a solid-state laser, a gas laser, and a semiconductor laser. Examples of the solid-state laser include a YAG laser and a titanium-sapphire laser. Examples of the gas laser include an argon laser, a helium-neon laser, and a carbon dioxide laser. The semiconductor laser is preferable because of its small size.

The fiber laser is a suitable light source in terms of its high peak energy and size reduction ability. The laser marking device 100 includes a scanning unit configured to scan the laser light based on input data. By changing the input data, it is possible to change the image to be formed on the side surface of the cap 20 of a container.

The content containing body producing apparatus according to the first embodiment forms an image on a cap of a container by the laser marking device 1000 serving as the first irradiation unit. Therefore, it is possible to change what is represented by the image for each content containing body. For example, it is possible to change what is represented by a barcode to be formed, depending on the kind of the content containing body. Moreover, image formation by laser light enables formation of an image on the side surface of a cap 20 of a container, the side surface of the cap 20 having a boss and recess profile and a curvature on the surface. The cap 20 of a container for the content containing body produced here is the cap of a container according to any of the first to third embodiments. Hence, an image formed on the side surface of the cap of a container can have a high readability.

In the step of producing the PET bottle drink 1, a laser marking device, which is the same as or different from the laser marking device 100 serving as the first irradiation unit may form an image representing, for example, product information such as a product name, a product logo, and ingredients or an amount of a drink on a container body of a container. In this way, a label-less content containing body can be provided as a product.

Figure 19:
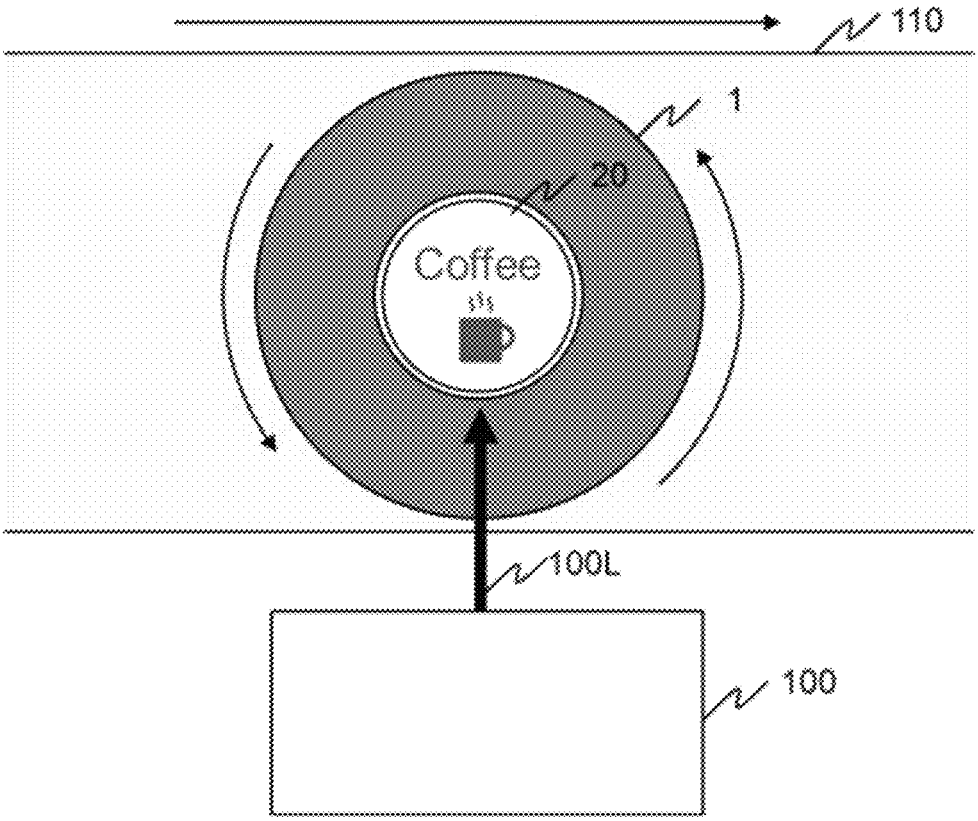
FIG. 19 is a schematic view illustrating an example of a content containing body producing apparatus according to a modified example 1 of a second embodiment.

Modified Example 1 of First Embodiment of Content Containing Body Producing Apparatus FIG. 19 is a view illustrating an example of a content containing body producing apparatus according to a modified example 1 of the first embodiment. In the modified example 1 of the first embodiment of the content containing body producing apparatus, any components that are the same as those in the first embodiment of the content containing body producing apparatus described above will be denoted by the same reference numerals and will not be described repeatedly.

In the modified example 1 of the first embodiment illustrated in FIG. 19, an image may be formed on the side surface of a cap 20 of a container with laser light 100L emitted by a laser marking device 100 serving as the first irradiation unit while a PET bottle drink 1, which is a content containing body, is moved by a belt conveyor 110 in the line moving direction indicated by a latitudinal arrow in FIG. 19 and rotated by an unillustrated rotating mechanism in the rotation direction of the PET bottle drink 1 indicated by curved arrows in FIG. 19.

By forming an image while rotating the content containing body in this way, it is possible to form an image on a wide range of the side surface of the cap 20 of a container. That is, it is possible to form images on a plurality of portions of the side surface of the cap 20 of a container, like the cap of a container according to the third embodiment illustrated in FIG. 15A and FIG. 15B.

When forming a barcode while rotating the content containing body, it is preferable to control input data representing the pattern of the barcode or scanning of the laser light 100L in a manner that the width of a minimum unit of the pattern in the circumferential direction of the cap 20 of a container is greater as the minimum unit is more apart from the center of the pattern of the barcode in the circumferential direction.

Figure 20:
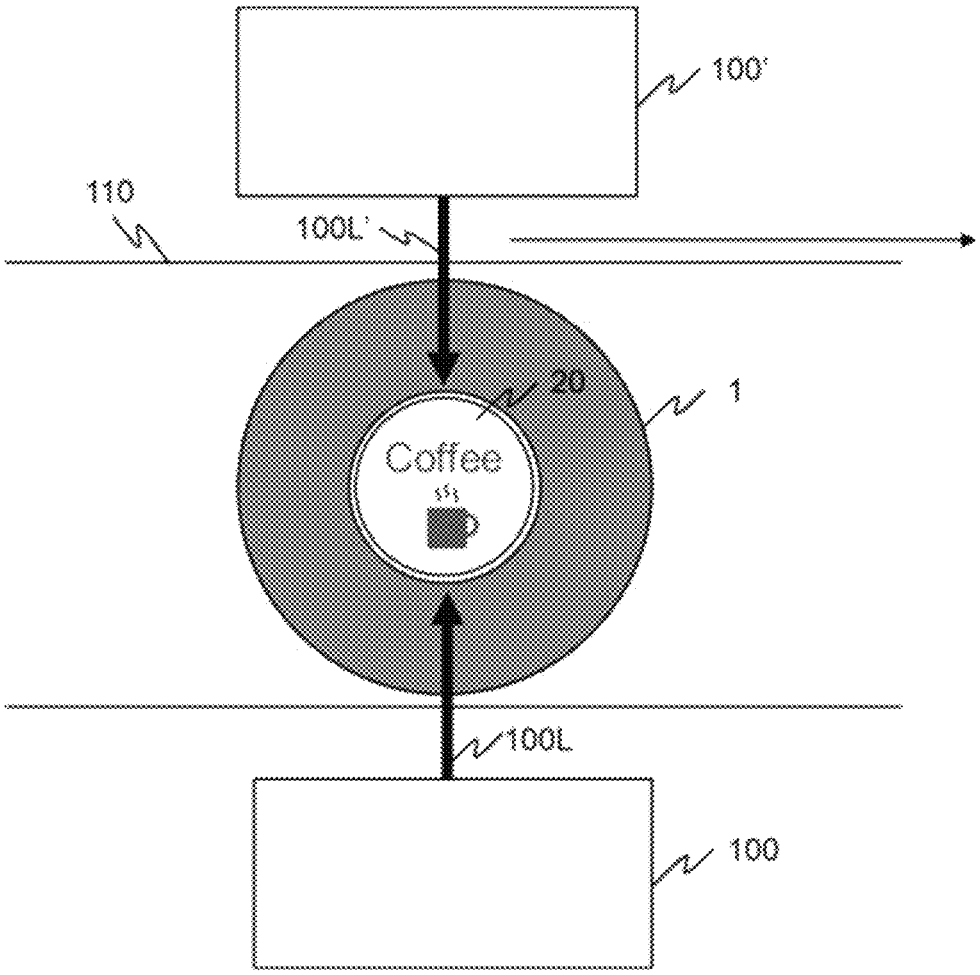
FIG. 20 is a schematic view illustrating an example of a content containing body producing apparatus according to a modified example 2 of the second embodiment.

Modified Example 2 of First Embodiment of Content Containing Body Producing Apparatus FIG. 20 is a view illustrating an example of a content containing body producing apparatus according to a modified example 2 of the first embodiment. In the modified example 2 of the first embodiment of the content containing body producing apparatus, any components that are the same as those in the first embodiment of the content containing body producing apparatus described above will be denoted by the same reference numerals and will not be described repeatedly.

As illustrated in FIG. 20, images may be formed on the side surface of a cap 20 of a container from both sides, using two laser marking devices 100 and 100' as the first irradiation unit.

By forming images from both sides in this way, it is possible to form images on a wide range of the side surface of the cap 20 of a container. That is, it is possible to form images on a plurality of portions of the side surface of the cap 20 of a container, like the cap of a container according to the third embodiment illustrated in FIG. 15A and FIG. 15B.

Moreover, one laser marking device 100 may form an image on the side surface of the cap 20 of a container, and another laser marking device 100' may form an image representing, for example, product information such as a product name, a product logo, and ingredients or an amount of a drink on the container body 10 of the container. In this way, a label-less content containing body can be provided as a product efficiently.

Aspects of the present disclosure are, for example, as follows.

<1> A cap of a container, the cap having an image formed thereon, the cap including:

a first part; and a second part, wherein when the cap is opened, the first part is separated from a container body of the container, and the second part remains on the container body of the container, and the image is formed on a region straddling both a side surface of the first part and a side surface of the second part.

<2> The cap of the container according to <1>, wherein the image is an identification code formed of a pattern represented by combination of a dark color portion and a bright color portion, and a visible letter represented by a letter that can be visibly observed, and the pattern of the identification code is formed on the side surface of the second part, and the visible letter of the identification code is formed on the side surface of the first part.

<3> A cap of a container, the cap having an image formed thereon, the cap including a first part that is separated from a container body of the container when the cap is opened, wherein the first part has a region having a smooth surface on at least a part of a side surface of the first part, and the image is formed on the region having the smooth surface.

<4> A cap of a container, the cap having an image formed thereon, the cap including:

a first part; and a second part, wherein when the cap is opened, the first part is separated from a container body of the container, and the second part remains on the container body of the container, and the image is formed dividedly on a plurality of portions of a side surface of the second part.

<5> The cap of the container according to any one of <1> to <4>, wherein the image is an identification code including a pattern represented by combination of a dark color portion and a bright color portion, and the pattern of the identification code is formed in a manner that a width of a minimum unit of the pattern in a circumferential direction of the cap is greater as the minimum unit is more apart from a center of the pattern in the circumferential direction.

<6> A method for producing a cap of a container, the method being intended for producing the cap of the container according to any one of <1> to <5>, the method including a first irradiation step of irradiating a side surface of the cap with laser light to form the image.

<7> A container cap producing apparatus intended for producing the cap of the container according to any one of <1> to <5>, the container cap producing apparatus including a first irradiation unit configured to irradiate a side surface of the cap with laser light to form the image.

<8> A container, including:

the cap of the container according to any one of <1> to <5>; and a container body.

<9> A content containing body, including:

the container according to <8>; and a content contained in the container.

<10> A method for producing a content containing body, the method being intended for producing the content containing body according to <9>, the method including a step of producing the cap of the container, the step being formed of the method for producing a cap of a container according to <6>.

<11> The method for producing a content containing body according to <10>, the method further including a second irradiation step of irradiating the container body with laser light to form an image.

<12> A content containing body producing apparatus intended for producing the content containing body according to <9>, the content containing body producing apparatus including a unit configured to produce the cap of the container, the unit being formed of the container cap producing apparatus according to <7>.

<13> The content containing body producing apparatus according to <12>, further including a second irradiation unit configured to irradiate the container body with laser light to form an image.

The cap of a container according to any one of <1> to <5>, the method for producing a cap of a container according to <6>, the container cap producing apparatus according to <7>, the container according to <8>, the content containing body according to <9>, the method for producing a content containing body according to <10> or <11>, and the content containing body producing apparatus according to <12> or <13> can solve the various problems in the related art and achieve the object of the present disclosure.

What is claimed is:

1. A cap of a container, the cap having an image formed thereon, the cap comprising:

a first part having a boss and recess profile; and a second part having a smooth profile, wherein when the cap is opened, the first part is separated from a container body of the container, and the second part remains on the container body of the container, and the image is formed on a region straddling both a side surface of the first part and a side surface of the second part, the image is an identification code formed of a barcode, the barcode represented by combination of a dark color portion and a bright color portion, and a visible letter, the visible letter represented by a letter that can be visibly observed, and the barcode is formed on the side surface of the second part, and the visible letter is formed on the side surface of the first part.

2. A method for producing a cap of a container, the method being intended for producing the cap of the container according to claim 1, the method comprising irradiating a side surface of the cap with laser light to form the image.

3. A method for producing a content containing body, the method being intended for producing a content containing body including:

a container; and a content contained in the container, wherein the container includes:

a cap of a container, the cap having an image formed thereon, and including a first part having a boss and recess profile and a second part having a smooth profile, wherein when the cap is opened, the first part is separated from a container body of the container and the second part remains on the container body of the container, and the image is formed on a region straddling both a side surface of the first part and a side surface of the second part, the image is an identification code formed of a barcode, the barcode represented by combination of a dark color portion and a bright color portion, and a visible letter, the visible letter represented by a letter that can be visibly observed, and the barcode is formed on the side surface of the second part, and the visible letter is formed on the side surface of the first part; and a container body, the method comprising producing the cap of the container, the producing being performed by the method for producing a cap of a container according to claim 2.

4. The method for producing a content containing body according to claim 3, the method further comprising irradiating the container body with laser light to form an image.

5. A container cap producing apparatus intended for producing the cap of the container according to claim 1, the container cap producing apparatus comprising a first irradiation unit configured to irradiate a side surface of the cap with laser light to form the image.

6. A content containing body producing apparatus intended for producing a content containing body including:

a container; and a content contained in the container, wherein the container includes:

a cap of a container, the cap having an image formed thereon, and including a first part having a boss and recess profile and a second part having a smooth profile, wherein when the cap is opened, the first part is separated from a container body of the container and the second part remains on the container body of the container, and the image is formed on a region straddling both a side surface of the first part and a side surface of the second part, the image is an identification code formed of a barcode, the barcode represented by combination of a dark color portion and a bright color portion, and a visible letter, the visible letter represented by a letter that can be visibly observed, and the barcode is formed on the side surface of the second part, and the visible letter is formed on the side surface of the first part; and a container body; and the content containing body producing apparatus comprising a unit configured to produce the cap of the container, the unit including the container cap producing apparatus according to claim 5.

7. The content containing body producing apparatus according to claim 6, further comprising a second irradiation unit configured to irradiate the container body with laser light to form an image.

8. A container, comprising:

the cap of the container according to claim 1; and a container body.

9. A content containing body, comprising:

the container according to claim 8; and a content contained in the container.

10. A cap of a container, the cap having an image formed thereon, the cap comprising a first part that is separated from a container body of the container when the cap is opened, wherein the first part has a first region having a boss and recess profile and a second region having a smooth surface on at least a part of a side surface of the first part, and the image is formed on the region having the smooth surface, the image is an identification code formed of a barcode, the barcode represented by combination of a dark color portion and a bright color portion, and a visible letter, the visible letter represented by a letter that can be visibly observed, and the barcode is formed on the second region, and the visible letter is formed on the first region.

11. A cap of a container, the cap having an image formed thereon, the cap comprising:

a first part having a boss and recess profile; and a second part having a smooth profile, wherein when the cap is opened, the first part is separated from a container body of the container, and the second part remains on the container body of the container, and the image is formed dividedly on a plurality of portions of a side surface of the second part, the image is an identification code formed of a barcode, the barcode represented by combination of a dark color portion and a bright color portion, and a visible letter, the visible letter represented by a letter that can be visibly observed, and the barcode is formed on the side surface of the second part, and the visible letter is formed on the side surface of the first part.

* * * * *